US007453369B2

(12) United States Patent
Chang et al.

(10) Patent No.: US 7,453,369 B2
(45) Date of Patent: Nov. 18, 2008

(54) SYSTEM AND METHOD FOR VOICE ALARM IN MEASURING A WORKPIECE

(75) Inventors: Chih-Kuang Chang, Tu-Cheng (TW); Zhong-Kui Yuan, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 136 days.

(21) Appl. No.: 11/309,421

(22) Filed: Aug. 4, 2006

(65) Prior Publication Data

US 2007/0120700 A1 May 31, 2007

(30) Foreign Application Priority Data

Nov. 25, 2005 (CN) ..... 2005 1 0101783

(51) Int. Cl.
*G08B 21/00* (2006.01)
*G08B 3/10* (2006.01)
*G10L 11/00* (2006.01)

(52) U.S. Cl. ..... 340/679; 340/680; 340/384.1; 704/270

(58) Field of Classification Search ..... None
See application file for complete search history.

(56) References Cited

U.S. PATENT DOCUMENTS

| | | | | | |
|---|---|---|---|---|---|
| 4,625,557 | A * | 12/1986 | Rutherford | ..... | 73/635 |
| 4,914,705 | A * | 4/1990 | Nigawara | ..... | 704/270 |
| 5,245,694 | A | 9/1993 | Zwern | | |
| 2007/0049363 | A1 * | 3/2007 | Green et al. | ..... | 455/575.2 |

FOREIGN PATENT DOCUMENTS

| | | |
|---|---|---|
| CN | 1032391 C | 7/1996 |
| TW | 1220970 | 9/2004 |

* cited by examiner

*Primary Examiner*—Julie Lieu
(74) *Attorney, Agent, or Firm*—Wei Te Chung

(57) ABSTRACT

A computer-based method for voice alarming in measuring a workpiece is provided. The method includes the steps of: configuring message commands; configuring triggering events that execute the message commands; measuring the workpiece; detecting whether any predetermined event is triggered when the workpiece is being measured; and executing the message commands by invoking speech synthesizers if the corresponding triggering event is detected. A related system is also disclosed.

15 Claims, 4 Drawing Sheets

SYSTEM AND METHOD FOR VOICE ALARM IN MEASURING A WORKPIECE

1. FIELD OF THE INVENTION

The present invention is related to a system and a method for voice alarm.

2. DESCRIPTION OF RELATED ART

In the prior art, various systems have been developed for permanently storing and replaying factory-programmed voice messages for more effectively grabbing an attention of an event. Such systems are now commonly installed in many vehicles for purposes of warning drivers regarding features of the vehicle's state, such as opened doors, unfastened seatbelts, and so on.

Nonetheless, these systems are imperfect, since the voice messages must be factory-programmed and do not allow to arbitrary replace the factory-programmed messages with new messages at a user's discretion, and, in some instances the factory-programmed messages are not even played back in the user's native language.

Furthermore, the development of computing systems has led a measuring technique not to be limited to a manual method any longer. The computer has been adopted to control a measuring machine to measure a workpiece automatically, thus increasing an efficiency of the measurement. However, during measuring, manual monitoring of the measuring is still required, otherwise, if an error happens, and the error is not dealt with in time, the measuring results may be inaccurate.

What is needed, therefore, is a system and method for voice alarm when measuring a workpiece. The system and method would allow receive message commands configured by a user who measures the workpiece, configure triggering events that execute corresponding message commands, and invoke speech synthesizers to produce human speech from the corresponding message commands via a audio device, thus alarming the user when triggering events, such as errors, happen, consequently improving accuracy of measurement, and more simple and convenient for the measuring' user.

SUMMARY OF THE INVENTION

A system for voice alarm in measuring a workpiece is provided in accordance with a preferred embodiment. The system includes: a receiving module for receiving message commands; a configuring module for configuring triggering events for executing the message commands; a detecting module for detecting triggering events when the workpiece is being measured; and a voice alarming module for executing the message commands if the corresponding triggering event is detected.

Another preferred embodiment provides a computer-based method for voice alarm in measuring a workpiece. The method includes the steps of: configuring message commands; configuring triggering events that execute the message commands; measuring the workpiece; detecting whether any predetermined event is triggered when the workpiece is being measured; and executing the message commands by invoking speech synthesizers if the corresponding triggering event is detected.

Other advantages and novel features of the present invention will be drawn from the following detailed description of a preferred embodiment and preferred method with the attached drawings.

DETAILED DESCRIPTION OF THE INVENTION

Figure 1:
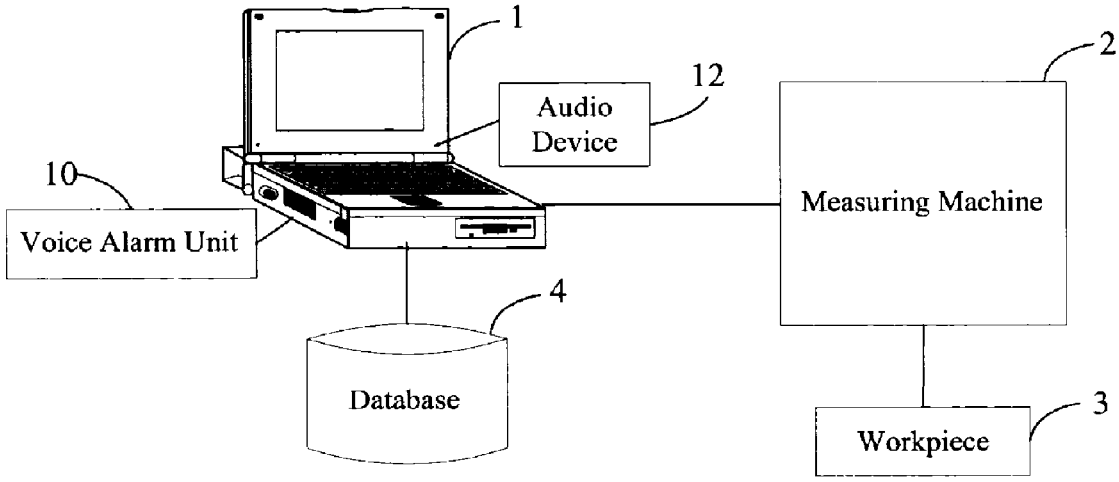
FIG. 1 is a schematic diagram of a hardware configuration of a system for voice alarm in measuring a workpiece in accordance with a preferred embodiment.

FIG. 1 is a schematic diagram of a hardware configuration of a system for a voice alarm in measuring a workpiece (hereinafter "the system"), in accordance with a preferred embodiment. The system typically includes a computer 1, a measuring machine 2, a workpiece 3 to be measured, and a database 4. The computer 1 connects to the measuring machine 2 and the database 4.

The computer 1 controls the measuring machine 2 to measure the workpiece 3 automatically by executing a measuring program. The computer 1 includes a voice alarm unit 10 and an audio device 12. For basic operations, the computer 1 may also include a central processing unit (CPU), a memory, and other units or hardware, such as a graphic accelerator card, a keyboard, and a mouse. However, in order to describe the preferred embodiment concisely, these units are not shown in the drawings.

The database 4 may include many authoritative dictionaries and specialized vocabularies. A lot of speech synthesizers are installed in the database 4, for reading the words and sentences that are in the authoritative dictionaries and the specialized vocabularies by using the audio device 12.

Figure 2:
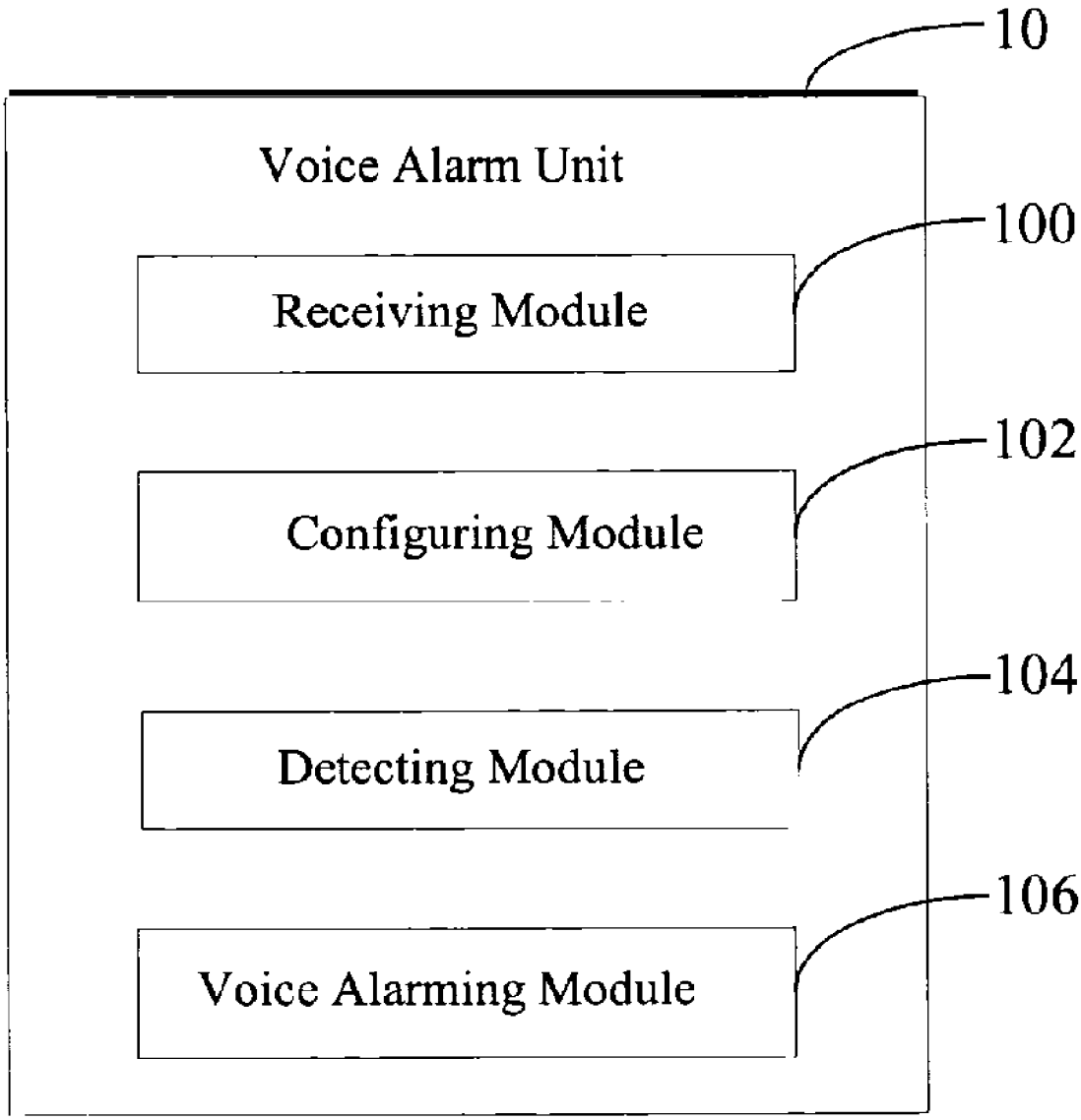
FIG. 2 is a schematic diagram of function modules of a voice alarm unit of FIG. 1.

FIG. 2 is a schematic diagram of function modules of the voice alarm unit 10. The voice alarm unit 10 includes: a receiving module 100, a configuring module 102, a detecting module 104, and a voice alarming module 106.

The receiving module 100 is used for receiving message commands configured by the user. The message command includes a message parameter field. The message command and the message parameter field may be in Chinese, in English, or in any other language. For example, if the message command object "m_Speak" is defined in the voice alarm unit 10, the receiving module 100 receives a syntax of the message command such as "m_Speak_Speak("equipment detect error")" where "equipment detect error" would correspond to the command parameter field of the message command.

The configuring module 102 is used for configuring triggering events that execute the message commands. The triggering events may be, such as, equipment errors, common errors, or end of measuring. The configuring module 102 is also used for configuring properties of the message commands. The properties may include volume, speed, and frequency.

The detecting module 104 is used for detecting the triggering events. The detecting module 104 is also used for detecting a language setting of the message commands, detecting whether the syntax of the message command is correct, and detecting if a spelling of the command parameter field is correct.

The voice alarming module 106 is used for invoking the speech synthesizers in the database 4 to produce the human speech of the message parameter field via the audio device 12, if the corresponding triggering event is detected.

Figure 3:
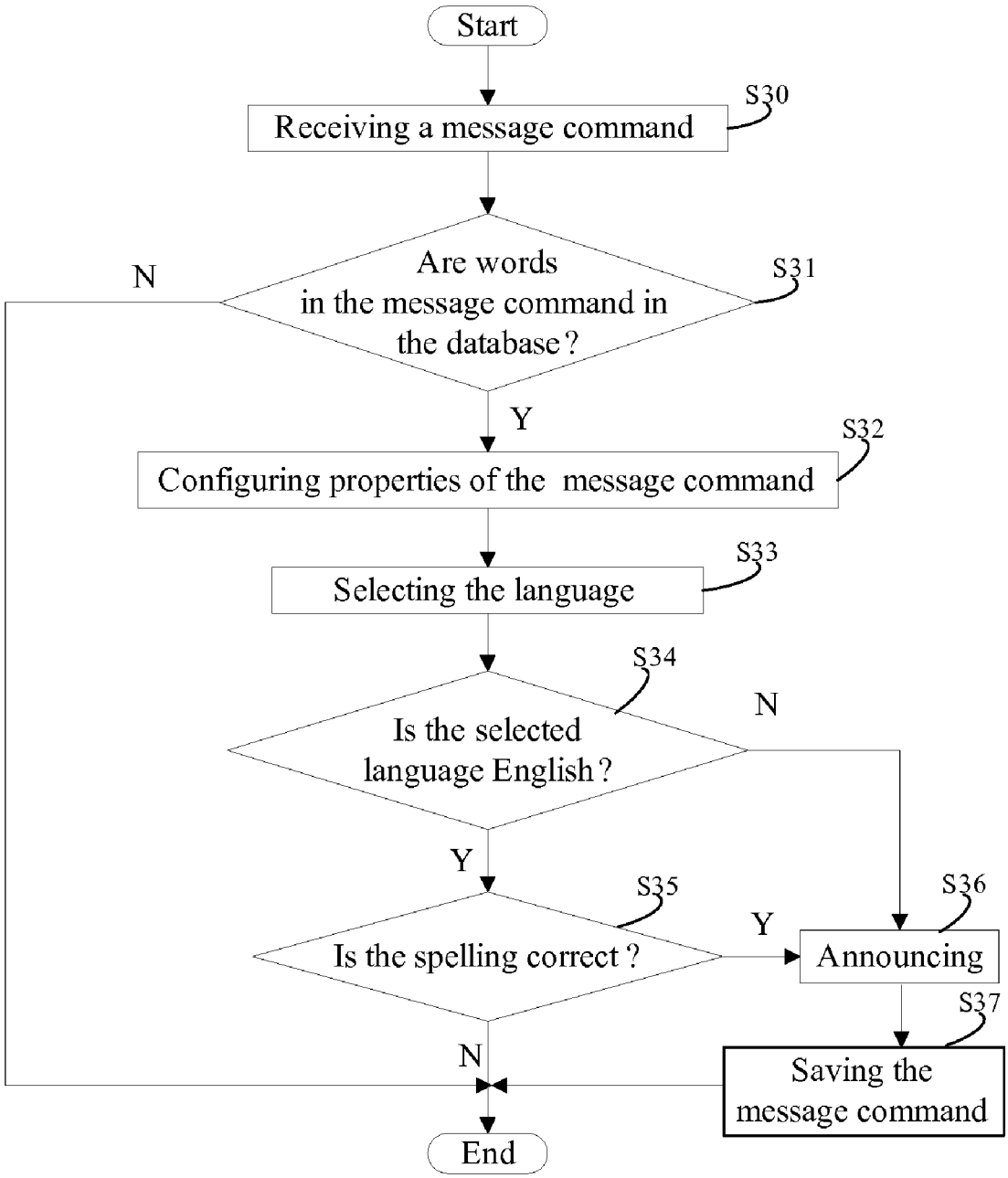
FIG. 3 is a flowchart illustrating a method for configuring voice messages in accordance with a preferred embodiment.

FIG. 3 is a flowchart illustrating a method for configuring a message command in accordance with a preferred embodiment. In step S30, the receiving module 100 receives a message command and a command parameter field configured by the user. In the embodiment, the message command corresponds to a specific event of the measurement, which may be, such as equipment errors, common errors, or end of measuring. For example, if the message command object "m_Speak" is defined in the voice alarm unit 10, the receiving module 100 receives the syntax of the message command such as "m_Speak.Speak("equipment detect error")" where "equipment detect error" corresponds to the message parameter field.

In step S31, the detecting module 104 detects whether words in the message parameter field are in the database 4. If the words are not in the database 4, the procedure ends. Otherwise, in step S32, the user configures properties of the message command through the configuring module 102. The properties include volume, speed, and frequency. An option "Volume" can be used for configuring the volume of the synthesized human speech when executing the message command. The scope of the volume can be 0 to 100. 0 is mute, and 100 is full volume. An option "speed" can be used for configuring the speed of the synthesized human speech. The scope of the rate can be −10 to 10. −10 is the lowest speed and 10 is the fastest speed. An option "Audio Output Stream Type" can be used for initializing the frequency of the synthesized human speech.

In step S33, the user selects the language of the message command. An option "Language" can be used for selecting the language. In the preferred embodiment, the language may be English or Chinese. In step S34, the detecting module 104 detects whether the selected language is English. If it is English, in step S35, the detecting module 104 further detects whether the spelling of the message parameter field is correct. If the spelling is wrong, the procedure ends. Otherwise, if the spelling is correct, in step S36, the voice alarming module 106 invokes the speech synthesizers in the database 4 to produce the human-like speech of the message parameter field via the audio device 12. In step S37, the voice alarming module 106 saves the message command in the computer 1. For example, if the message parameter field configured by the user is in English, such as "Circle", the voice alarming module 106 reads "['sə:kl]" by invoking the speech synthesizers via the audio device 12. If the received voice message is in Chinese, such as "圆" (Chinese character for circle), the detecting module 104 detects that the spelling is incorrect, and the procedure ends.

If in step S34 the selected language is Chinese, the procedure goes directly to step S36. For example, if the message parameter field configured by the user is in Chinese, such as "圆", the voice alarming module 106 reads "yuan" (pinyin of the Chinese character "圆") by invoking the speech synthesizers via the audio device 12. If the received message parameter field is in English, such as "circle", the voice alarming module 106 reads "C, I, R, C, L, E". Other message commands can also be configured by repeating the above-described steps.

Figure 4:
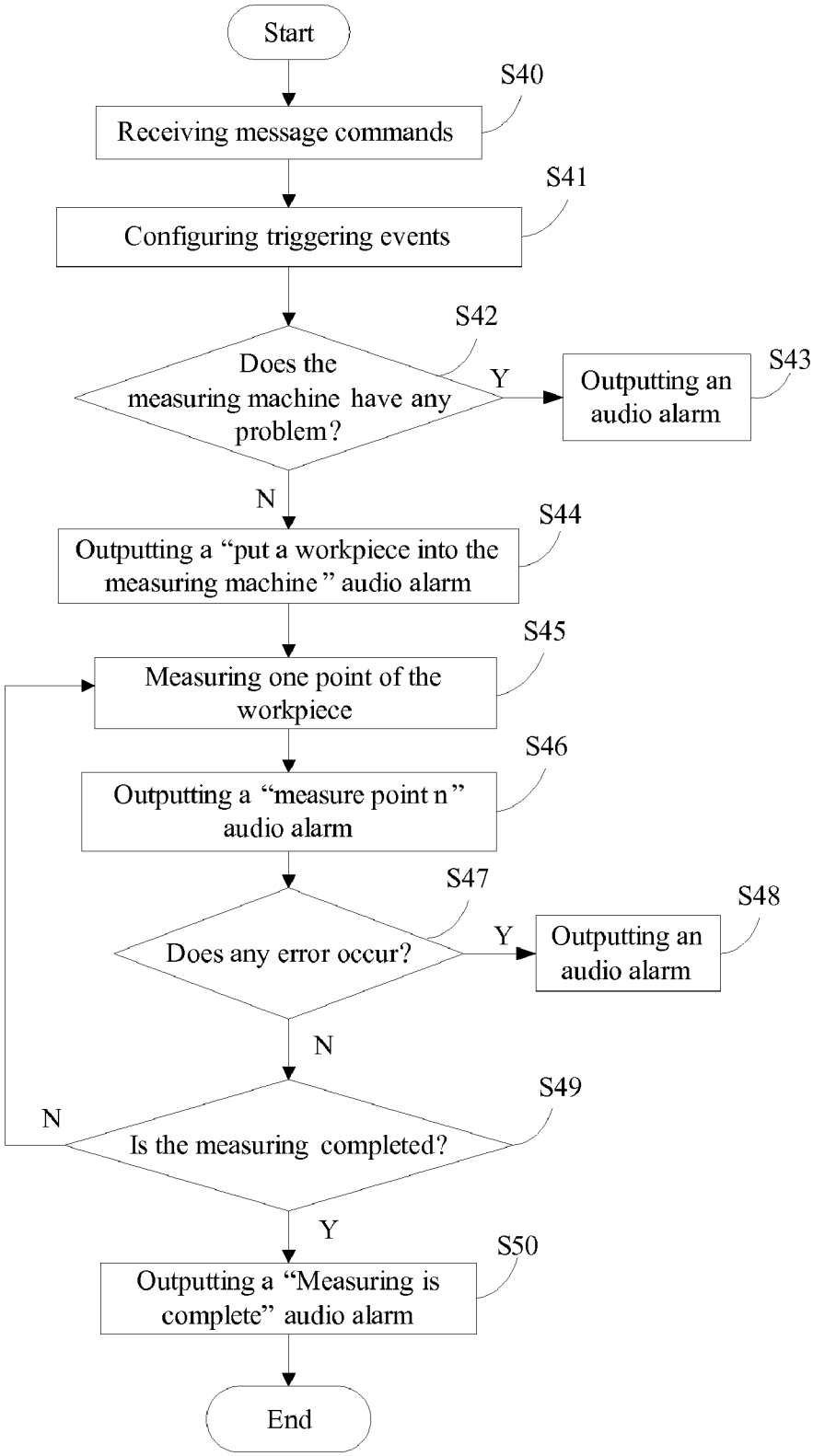
FIG. 4 is a flowchart illustrating a preferred method for voice alarm in measuring a workpiece in accordance with a preferred embodiment.

FIG. 4 is a flowchart illustrating a method for voice alarm in measuring a workpiece in accordance with a preferred embodiment. In step S40, the receiving module 100 receives message commands configured by a user. Detailed description of step S40 has been provided above in relation to FIG. 3. In step S41, the configuring module 102 configures triggering events for executing the message commands. The triggering events are equipment errors, common errors, or end of measuring. In step S42, the detecting module 104 detects whether errors or malfunctions in the measuring machine 2 occur. If any error or malfunction occurs, in step S43, the voice alarming module 106 invokes the speech synthesizers and outputs a "equipment detect error" audio alarm. In step S44, the voice alarming module 106 outputs a "put a workpiece into the measuring machine" audio alarm. In step S45, the measuring machine 2 begins to measure one point of the workpiece 3 by executing the measuring program in the computer 1. In step S46, the voice alarming module 106 outputs a "measuring point n" audio alarm. Here, "n" represents a count of measuring points that the measuring machine 2 has measured. In step S47, the detecting module 104 detects whether any common error occurs. If any error occurs, in step S48, the voice alarming module 106 outputs an audio alarm accordingly. In step S49, the detecting module 104 detects whether the measuring has completed. If the measuring has completed, in step S50, the voice alarming module 106 outputs a "measuring is complete" audio alarm. Otherwise, the procedure returns to step S45 described above.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A system for voice alarm in measuring a workpiece, the system comprising:

a computer connected to a database;

the database comprising authoritative dictionaries specialized vocabularies and speech synthesizers; and the computer comprising:

a receiving module configured for receiving message commands;

a configuring module configured for configuring triggering events for executing the message commands;

a detecting module configured for detecting the triggering events when the workpiece is being measured; and a voice alarming module configured for executing one or more of the message commands when the corresponding triggering event is detected.

2. The system according to claim 1, wherein the configuring module is further configured for configuring properties of the message commands.

3. The system according to claim 2, wherein the properties comprise volume, speed, and frequency.

4. The system according to claim 1, wherein each of the message commands comprises a message parameter field, and words of the message parameter field come from at least one of the authoritative dictionaries and the specialized vocabularies of the database.

5. The system according to claim 4, wherein each of the message commands is executable by invoking the speech synthesizers to produce human-like speech of the words of the message parameter field.

6. A computer-based method for voice alarm in measuring a workpiece, the method comprising the steps of:

configuring message commands, comprising:

receiving the message commands configured by a user;

detecting whether words of message parameter fields in the message commands are in a database, wherein the database comprises authoritative dictionaries, specialized vocabularies, and speech synthesizers;

configuring properties of the message commands when the words are in the database;

selecting a language;

outputting the message parameter fields of the message commands by invoking the speech synthesizers; and saving the message commands;

configuring predetermined triggering events that execute the message commands;

measuring the workpiece;

detecting whether any predetermined event is triggered when the workpiece is being measured; and executing one or more of the message commands by invoking the speech synthesizers to produce human-like speech of the words of the corresponding one or more message parameter fields when the corresponding triggering event is detected.

7. The method according to claim 6, wherein the language is one of English and Chinese.

8. The method according to claim 7, further comprising:

detecting whether the spelling of the words of the message parameter fields is correct when the selected language is English.

9. The method according to claim 6, wherein the properties comprise volume, speed, and frequency.

10. The method according to claim 6, wherein the detecting and executing steps comprise:

outputting a "put a workpiece into the measuring machine" audio alarm;

measuring one point of the workpiece;

outputting a "measure point n" audio alarm;

detecting whether any predetermined event occurs while measuring;

outputting an audio alarm according to the message command corresponding to the occurred event;

detecting whether the measuring is complete; and outputting a "measuring is complete" audio alarm when the measuring is complete.

11. The method according to claim 10 further comprising:

returning to the step of measuring one point of the workpiece when the measuring is not complete.

12. A system for voice alarm in measuring a workpiece, the system comprising:

a computer having a voice alarm unit installed therein, the voice alarm unit comprising:

a receiving module configured for receiving message commands;

a configuring module configured for configuring properties of the message commands, wherein the properties of the message commands comprise volume, speed, and frequency, the configuring module also configured for configuring triggering events for executing the message commands;

a detecting module configured for detecting the triggering events when the workpiece is being measured; and a voice alarming module configured for executing one or more of the message commands when the corresponding triggering event is detected.

13. The system according to claim 12, wherein the computer is connected to a database, and each of the message commands comprises a message parameter field, and words of the message parameter field come from at least one of authoritative dictionaries and specialized vocabularies of the database.

14. The system according to claim 13, wherein each of the message commands is executable by invoking speech synthesizers of the database to produce human-like speech of the words of the message parameter field.

15. The system according to claim 13, wherein the words of the message parameter field are in at least one of the Chinese language and the English language.

* * * * *